US006353423B1

(12) United States Patent
Kang et al.

(10) Patent No.: US 6,353,423 B1
(45) Date of Patent: Mar. 5, 2002

(54) METHOD FOR DRIVING PLASMA DISPLAY PANEL

(75) Inventors: Kyoung-ho Kang, Asan; Jeong-duk Ryeom; Yoon-phil Eo, both of Chonan, all of (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/477,000

(22) Filed: Jan. 3, 2000

(30) Foreign Application Priority Data

Feb. 27, 1999 (KR) ..... 99-6640

(51) Int. Cl.[7] ..... G09G 3/28
(52) U.S. Cl. ..... 345/60; 345/63
(58) Field of Search ..... 345/60–63, 66, 345/68, 67, 690; 315/169.1–169.4; 313/581, 585

(56) References Cited

U.S. PATENT DOCUMENTS 6,054,970 A * 4/2000 Hirakawa et al. ..... 345/60
6,072,448 A * 6/2000 Kojima et al. ..... 345/63
6,292,159 B1 * 6/2001 Someya et al. ..... 345/60
6,262,699 B1 * 7/2001 Suzuki et al. ..... 345/63
6,317,105 B1 * 11/2001 Eo et al. ..... 345/60

* cited by examiner

*Primary Examiner*—Regina Liang
(74) *Attorney, Agent, or Firm*—Leydig, Voit & Mayer, Ltd.

(57) ABSTRACT

A driving method of a plasma display panel for gray-scale display using subfields, in each of which an address step, a sustaining discharge step, and a reset step are performed. The method includes dividing the unit frame into unit drive periods corresponding to the number of gray scales, trisecting each unit drive period into a unit address period, a unit sustaining discharge period, and a unit reset period, dividing each unit address period into the same number of time intervals as there are subfields and allocating the divided time intervals to the respective subfields, starting the respective subfields sequentially with a time interval corresponding to the unit drive period and overlapping one another, and applying an address voltage between the scan electrode line and the address electrode line corresponding to the first unit drive period of the subfields during the time interval allocated to each unit address period, applying a sustaining discharge voltage between the common electrode lines and all the scan electrode lines during all the unit sustaining discharge periods, and applying a reset voltage between the common electrode lines and the scan electrode lines corresponding to the last unit drive period of the subfields during each unit reset period.

2 Claims, 3 Drawing Sheets

METHOD FOR DRIVING PLASMA DISPLAY PANEL

BACKGROUND OF THE INVENTION

1. Field of the Invention

The present invention relates to a method for driving a plasma display panel, and more particularly, to a method for driving a plasma display panel, by which gray-scale display is achieved in a unit frame by a plurality of subfields in each of which an address step, a sustaining discharge step and a reset step are performed.

2. Description of the Related Art

FIG. 1 shows a general plasma display panel, FIG. 2 shows an electrode line pattern of the plasma display panel shown in FIG. 1, and FIG. 3 shows an example of a pixel of the plasma display panel shown in FIG. 1. Referring to the drawings, address electrode lines $A_1$, $A_2$, $A_3$, . . . , $A_{m-2}$, $A_{m-1}$ and $A_m$, a dielectric layer 11 (or 141 of FIG. 3), scan electrode lines $Y_1$, $Y_2$, . . . $Y_{n-}$and $Y_n$, common electrode lines $X_1$, $X_2$, . . . , $X_{n-1}$ and $X_n$, and a magnesium oxide (MgO) layer 12 as a protective membrane are provided between front and rear glass substrates 10 and 13 of a general surface-discharge type plasma display panel 1.

The address electrode lines $A_1$, $A_2$, $A_3$, . . . , $A_{m-2}$, $A_{m-1}$, and $A_m$ are disposed on the front surface of the rear glass substrate 13 in a predetermined pattern. A phosphor (142 of FIG. 3) is disposed on the front surface of the scan electrode lines $Y_1$, $Y_2$, . . . $Y_{n-1}$ and $Y_n$. Otherwise, in the case in which the dielectric layer 141 is disposed on the front surface of the common electrode lines $X_1$, $X_2$, . . . , $X_{n-1}$ and $X_n$, the phosphor 142 may be the dielectric layer (141 of FIG. 3).

The common electrode lines $X_1$, $X_2$, . . . , $X_{n-1}$ and $X_n$ and the scan electrode lines $Y_1$, $Y_2$, . . . , $Y_{n-1}$ and $Y_n$ are formed on the rear surface of the front glass substrate 10 in a predetermined pattern, orthogonal to the address electrode lines $A_1$, $A_2$, $A_3$, . . . , $A_{m-2}$, $A_{m-1}$ and $A_m$. Pixels are defined at the respective points of intersection. The respective common electrode lines $X_1$, $X_2$, . . . , $X_{n-1}$ and $X_n$ and the respective scan electrode lines $Y_1$, $Y_2$, . . . $Y_{n-1}$ and $Y_n$ are constituted by indium tin oxide (ITO) electrode lines $X_{na}$ and $Y_{na}$ shown in FIG. 3 and metal bus electrode lines $X_{nb}$ and $Y_{nb}$ shown in FIG. 3. The dielectric layer 11 coats the rear surface of the common electrode lines $X_1$, $X_{21}$, . . . , $X_{n-1}$ and $X_n$ and the scan electrode lines $Y_1$, $Y_2$, . . . $Y_{n-1}$ and $Y_n$. The magnesium monoxide (MgO) layer 12 for protecting the panel 1 against a strong electrical field coats the rear surface of the dielectric layer 11. A discharge space 14 is filled with plasma forming gas.

The plasma display panel thus constructed is basically driven such that the reset step, the address step and the sustaining discharge step are sequentially performed on unit subfields. In the reset step, wall charges remaining on the previous subfield are eliminated. In the address step, wall charges are formed in a selected pixel region. In the sustaining discharge step, light is generated at the pixel in which the wall charges are formed in the address step. In other words, if an alternating pulse having a relatively high voltage is applied between the common electrode-lines $X_1$, $X_2$, . . . , $X_{n-1}$ and $X_n$ and the scan electrode lines $Y_1$, $Y_2$, . . . $Y_{n-1}$ and $Y_n$, a surface discharge occurs at the wall-charge formed pixel. Here, a plasma is formed in the discharge space 14 and the phosphor 142 is excited by ultraviolet radiation to generate light.

Here, multiple unit subfields operating based on the above-described driving principle are included in the unit frame, so that desired gray scale display can be achieved with the interval of sustaining discharge periods of the respective subfields.

The conventional driving methods using such driving principles include an address-display-separation driving method and an address-while-display driving method.

According to the address-display separation driving method, an address period and a sustaining discharge period are separated in a unit subfield set for gray-scale display. Accordingly, it is easy to design and modify a driving apparatus and the configuration of the driving apparatus is simplified. However, the sustaining discharge period is made to be relatively shorter, which lower display luminance.

According to the address-while-driving method, an address period is included within a display period of each subfield and the respective subfields start sequentially with a unit time interval for each scan electrode line and overlap with one another. Accordingly, the sustaining discharge period is relatively longer, which increases display luminance. However, it is difficult to design and modify the driving apparatus and the driving apparatus becomes complicated.

SUMMARY OF THE INVENTION

To solve the above problems, it is an object of the present invention to provide a method for driving a plasma display panel by which a driving apparatus can be easily designed and modified, the configuration of the driving apparatus is simplified and display luminance is enhanced.

Accordingly, to achieve the above object, there is provided a driving method of a plasma display panel for performing gray-scale display by a plurality of subfields in each of which an address step, a sustaining discharge step and a reset step are performed. The method includes the step of dividing the unit frame to be displayed into unit drive periods corresponding to the number of gray scales. Each unit drive period is into three periods; a unit address period, a unit sustaining discharge period and a unit reset period. The respective unit address periods are equal to one another, the respective unit sustaining discharge periods are equal to one another and the respective unit reset periods are equal to one another. Each unit address period is divided into the same number of time intervals as there are subfields and the divided time intervals are allocated to the respective subfields, allowing the respective subfields to start sequentially with a time interval corresponding to the unit drive period to then overlap with one another. An address voltage is applied between the scan electrode line and the address electrode line corresponding to the first unit drive period of the subfields during the time interval allocated to each unit address period. A sustaining discharge voltage is applied between the common electrode lines and all the scan electrode lines during all the unit sustaining discharge periods, and a reset voltage is applied between the common electrode lines and the scan electrode lines corresponding to the last unit drive period of the subfields during each unit reset period.

During every unit sustaining discharge period, even if a sustaining discharge voltage is applied between the common electrode lines and scan electrode lines, a sustaining discharge is performed at only the pixels selected in the directly previous address period and having wall charges formed therein.

As described above, according to the driving method of the present invention, the plasma display panel is driven for each unit drive period, and a sustaining discharge voltage is applied between the common electrode lines and scan electrode lines during every unit sustaining discharge period. Accordingly, the design and modification of the driving apparatus is facilitated and the configuration of the driving apparatus is simplified. Also, the respective subfields sequentially start with a time interval corresponding to the unit drive period with respect to each scan electrode line to then overlap with one another. Accordingly, the length of the sustaining discharge period within a unit frame becomes relatively larger, thereby enhancing the display luminance.

BRIEF DESCRIPTION OF THE DRAWINGS

The above object and advantages of the present invention will become more is apparent by describing in detail a preferred embodiment thereof with reference to the attached drawings in which.

DESCRIPTION OF THE PREFERRED EMBODIMENT

Figure 1:
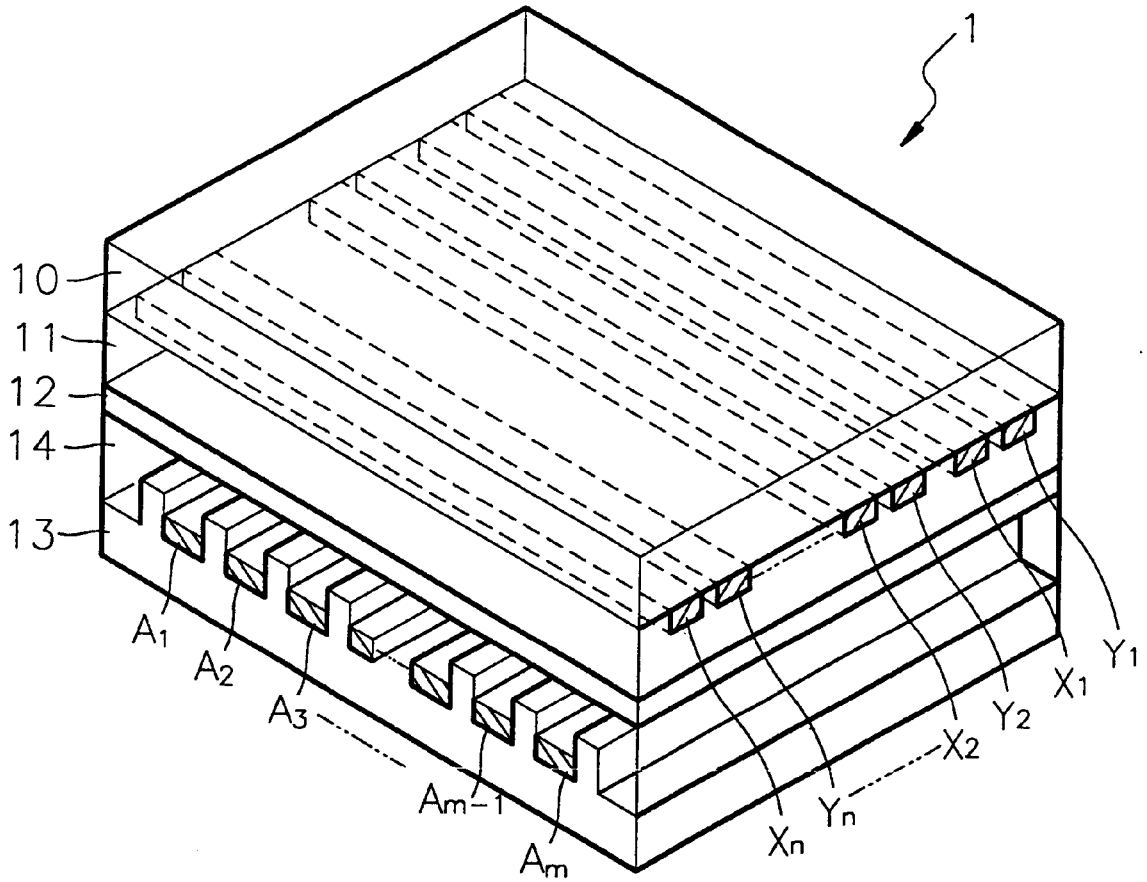
FIG. 1 shows a general plasma display panel.
Figure 2:
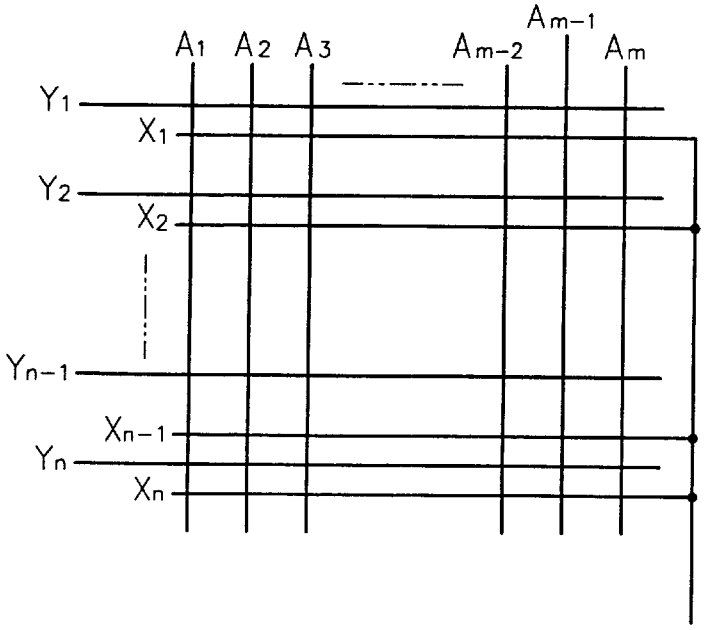
FIG. 2 shows an electrode line pattern of the plasma display panel shown in FIG. 1.
Figure 3:
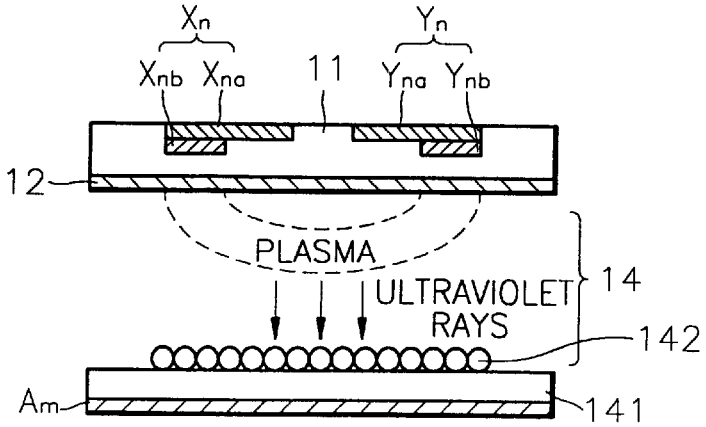
FIG. 3 shows an example of a pixel of the plasma display panel shown in FIG. 1.
Figure 4:
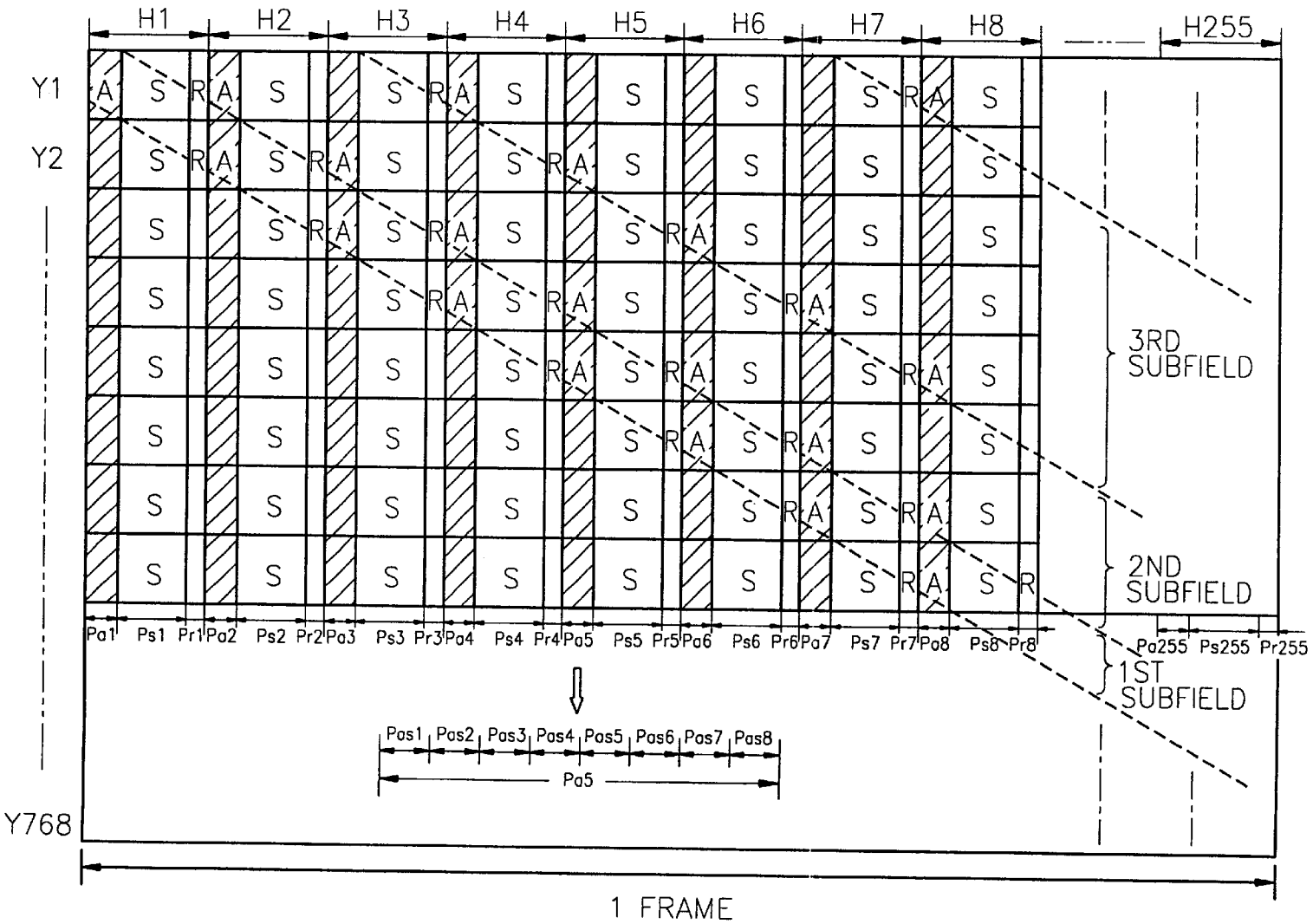
FIG. 4 shows a unit frame for illustrating a driving method according to an embodiment of the present invention.

A driving method according to an embodiment of the present invention shown in FIG. 4 is applied to a plasma display panel, in which 768 common electrode lines X1, . . . and X768, 768 scan electrode lines Y1, . . . and Y768 and address electrode lines $A_1$, . . . and $A_m$ are arranged between a front substrate (4 of FIG. 1) and a rear substrate (13 of FIG. 1), opposingly spaced apart from each other, the common electrode lines X1, . . . and X768 are parallel to the scan electrode lines Y1, . . . and Y768, the address electrode lines $A_1$, . . . and $A_m$ are orthogonal to the scan electrode lines Y1, . . . and Y768, so that pixels are defined at the respective points of intersection. Also, the driving method for 256-level gray scale display uses 8 subfields in each of which an address step, a sustaining discharge step and a reset step are performed in a unit frame.

Referring to FIG. 4, one unit frame to be displayed is divided into 255 unit drive periods H1, . . . and H256, one fewer than the number of gray scales. The respective unit drive periods H1, . . . and H256 are divided into three period types; unit address periods Pa1, . . . and Pa256, unit sustaining discharge periods Ps1, . . . and Ps256, and unit reset periods Pr1, . . . and Pr256. Here, the respective unit address periods Pa1, . . . and Pa256 equal to one another, the respective unit sustaining discharge periods Ps1, . . . and Ps256 equal to one another, and the respective unit reset periods Pr1, . . . and Pr256 equal to one another.

The respective subfields start sequentially with a time interval corresponding to the unit drive periods H1, . . . and H256 with respect to the respective scan electrode lines Y1, . . . and Y768, and overlap with one another. The timing ranging from the starting point of each subfield to the terminating point occupies one frame. However, since the respective subfields are superimposed at any timing, all subfields are included in one frame.

The first subfield includes the nth unit drive period with respect to the nth scan electrode line. The second subfield includes the (n+1)th and (n+2)th unit drive periods with respect to the nth scan electrode line. The third subfield includes the (n+3)th through (n+6)th unit drive periods with respect to the nth scan electrode line. The fourth subfield includes the (n+7)th through (n+14)th unit drive periods with respect to the nth scan electrode line. The fifth subfield includes the (n+15)th through (n+30)th unit drive periods with respect to the nth scan electrode line. The sixth subfield includes the (n+31)th through (n+62)th unit drive periods with respect to the nth scan electrode line. The seventh subfield includes the (n+63)th through (n+126)th unit drive periods with respect to the nth scan electrode line. The eighth subfield includes the (n+127)th through (n+254)th unit drive periods with respect to the nth scan electrode line. Accordingly, a 256-level gray-scale display can be achieved.

Each of the unit address periods Pa1, . . . and Pa256 is divided into 8 time intervals Pas1, . . . and Pas8, corresponding to the number of subfields. In detail, the respective divided time intervals Pas1, . . . and Pas8 are allocated to each subfield. In other words, the first time intervals Pas1 of the respective unit address periods Pa1, . . . and Pa256 are allocated to the first subfield. The second time intervals Pas2 are allocated to the second subfield, the third time intervals Pas3 are allocated to the third subfield, the fourth time intervals Pas4 are allocated to the fourth subfield, the fifth time intervals Pas5 are allocated to the fifth subfield, the sixth time intervals Pas6 are allocated to the sixth subfield, the seventh time intervals Pas7 are allocated to the seventh subfield, and the eighth time intervals Pas8 are allocated to the eighth subfield. As described above, the reason of the respective unit address periods Pa1, . . . and Pa256 are divided into each 8 time intervals and allocated to each subfield is that all the subfields overlap at every timing. In other words, the reason of the foregoing is for addressing only one pixel at each timing by addressing at different timings.

During the time intervals each allocated to the respective unit address periods Pa1, . . . and Pa256, an address voltage is applied between one of the scan electrode lines Y1, . . . and Y768 corresponding to the first unit drive period of the subfields and one of the addressing electrode lines A1, . . . and Am. During all unit sustaining discharge periods Ps1, . . . and Ps256, a sustaining discharge voltage is alternately applied between the common electrode lines X1, . . . and X768 and all the scan electrode lines Y1, . . . and Y768. In other words, plural pulses are alternately applied to the common electrode lines X1, . . . and X768 and all the scan electrode lines Y1, . . . and Y768 during all unit sustaining discharge periods Ps1, . . . and Ps256. During the respective reset periods Pr1, . . . and Pr256, a sustaining discharge voltage is applied between the common electrode lines X1, . . . and X768 and 8 lines of the scan electrode lines Y1, . . . and Y768 corresponding to the final unit drive period of the subfields, corresponding to the number of subfields.

For example, the driving procedure in the first and second drive periods H1 and H2 will now be described.

During the first time interval Pas1 of the first unit address period Pa1, an address voltage is applied between the first scan electrode line Y1 and an addressing electrode corresponding thereto, that is, one of A1, . . . and Am, so that wall charges are generated at the pixel to be displayed. During the first unit sustaining discharge period Ps1, a sustaining discharge voltage is applied between the common electrode lines X1, . . . and X768 and all the scan electrode lines Y1, . . . and Y768. Accordingly, a sustaining discharge occurs at the pixels to be displayed. During the first unit reset period Pr1, a reset voltage is applied between the common electrode lines X1, . . . and X768 and 8 scan electrode lines Y1, Y2, . . . corresponding to the last unit drive period of the subfields. Accordingly, a reset discharge occurs at the pixels corresponding to the last timing of the subfields.

During the first time interval Pas1 of the second unit address period Pa2, an address voltage is applied between the first scan electrode line Y1 and an addressing electrode corresponding thereto, that is, one of A1, . . . and Am, so that wall charges are generated at the pixel to be displayed. During the second time interval Pas2 of the second unit address period Pa2, an address voltage is applied between the second scan electrode line Y2 and an addressing electrode corresponding thereto, that is, one of A1, . . . and Am, so that wall charges are generated at the pixel to be displayed. During the second unit sustaining discharge period Ps2, a sustaining discharge voltage is applied between the common electrode lines X1, . . . and X768 and all the scan electrode lines Y1, . . . and Y768. Accordingly, a sustaining discharge is performed at the pixels to be displayed. During the second unit reset period Pr2, a reset voltage is applied between the common electrode lines X1, . . . and X768 and 8 scan electrode lines Y2, Y3, . . . corresponding to the last unit drive period of the subfields. Accordingly, a reset discharge occurs at the pixels corresponding to the last timing of the subfields.

As described above, according to the driving method of a plasma display panel of the present invention, the plasma display panel is driven in accordance with the respective unit drive periods H1, . . . and H256. Also, during all unit sustaining discharge periods Ps1, . . . and Ps256, a sustaining discharge voltage is applied between the common electrode lines X1, . . . and X768 and all the scan electrode lines Y1, Y2, . . . and Y768. Accordingly, it is easy to design and modify the driving apparatus, and the configuration of the driving apparatus is simplified. Also, the respective subfields start sequentially with time intervals of the unit drive periods with respect to the respective scan electrode lines Y1, Y2, . . . and Y768 and overlap with one another. Accordingly, within a unit frame, the length of the sustaining discharge period, that is, Ps1+Ps2+. . . +Ps256, is relatively large, thereby enhancing display luminance.

The present invention is not limited to the above-described embodiment but various changes and modifications may be effected by one skilled in the art within the scope of the invention as defined in the appended claims.

What is claimed is:

1. A driving method for gray-scale display using a plurality of subfields in each of which an address step, a sustaining discharge steps and a reset step are respectively performed, in a unit frame of a plasma display panel having a front substrate and a rear substrate, opposingly spaced apart from each other, and in which common electrode lines, scan electrode lines, and address electrode lines are arranged between the front substrate and the rear substrate, the common electrode lines being parallel to the scan electrode lines, and the address electrode lines being orthogonal to the scan electrode lines so that pixels are defined at respective crossing points of the scan electrode lines and the address electrode lines, the driving method comprising:

dividing the unit frame to be displayed into unit drive periods corresponding to the number of gray scale steps;

trisecting each unit drive period into a unit address period, a unit sustaining discharge period, and a unit reset period, the respective unit address periods being equal to one another, the respective unit sustaining discharge periods being equal to one another, and the respective unit reset periods being equal to one another;

dividing each unit address period into the same number of time intervals as there are subfields and allocating the time intervals to respective subfields;

sequentially starting the respective subfields with a time interval corresponding to the unit drive period and overlapping with one another, and applying an address voltage between the scan electrode line and the address electrode line corresponding to the first unit drive period of the subfields during the time interval allocated to each unit address period;

applying a sustaining discharge voltage between the common electrode lines and all the scan electrode lines during all the unit sustaining discharge periods; and applying a reset voltage between the common electrode lines and the scan electrode lines corresponding to the last unit drive period of the subfields during each unit reset period.

2. The method according to claim 1, wherein in applying a sustaining discharge voltage, applying plural pulses alternately to the common electrode lines and all the scan electrode lines.

* * * * *